US005697824A

United States Patent [19]

Xie et al.

[11] Patent Number: 5,697,824

[45] Date of Patent: Dec. 16, 1997

[54] METHOD FOR PRODUCING THIN UNIFORM POWDER PHOSPHOR FOR DISPLAY SCREENS

[75] Inventors: Chenggang Xie, Cedar Park; Donald E. Patterson, Houston; Nalin Kumar, Canyon Lake, all of Tex.

[73] Assignees: Microelectronics and Computer Technology Corp.; SI Diamond Technology, Inc., both of Austin, Tex.

[21] Appl. No.: 488,066

[22] Filed: Jun. 7, 1995

Related U.S. Application Data

[62] Division of Ser. No. 304,918, Sep. 13, 1994, Pat. No. 5,531,880.

[51] Int. Cl.[6] ..... H01J 9/22; H01J 9/18

[52] U.S. Cl. ..... 445/24; 445/52

[58] Field of Search ..... 445/24, 52

[56] References Cited

U.S. PATENT DOCUMENTS

| | | |
|---|---|---|
| 1,954,691 | 4/1934 | de Boer et al. . |
| 2,851,408 | 9/1958 | Cerulli et al. . |
| 2,867,541 | 1/1959 | Coghill et al. . |
| 2,959,483 | 11/1960 | Kaplan . |
| 3,070,441 | 12/1962 | Schwartz . |
| 3,108,904 | 10/1963 | Cusano . |
| 3,314,871 | 4/1967 | Heck et al. . |
| 3,360,450 | 12/1967 | Hays . |
| 3,481,733 | 12/1969 | Evans . |
| 3,525,679 | 8/1970 | Wilcox et al. . |
| 3,554,889 | 1/1971 | Hyman et al. . |
| 3,808,048 | 4/1974 | Strik . |
| 3,898,146 | 8/1975 | Rehkopf et al. . |
| 4,482,447 | 11/1984 | Mizuguchi et al. . |
| 4,507,562 | 3/1985 | Braunlich et al. . |
| 4,512,912 | 4/1985 | Matsuda et al. . |
| 4,542,038 | 9/1985 | Odaka et al. . |
| 4,633,131 | 12/1986 | Khurgin . |
| 4,647,400 | 3/1987 | Dubroca et al. . |
| 4,684,540 | 8/1987 | Schulze . |
| 4,687,825 | 8/1987 | Sagou et al. . |
| 4,758,449 | 7/1988 | Kimura et al. . |
| 4,816,717 | 3/1989 | Harper et al. . |
| 4,889,690 | 12/1989 | Lubbers et al. . |
| 4,892,757 | 1/1990 | Kasenga et al. . |
| 4,900,584 | 2/1990 | Tuenge et al. . |
| 4,956,202 | 9/1990 | Kasenga et al. . |
| 4,990,416 | 2/1991 | Mooney . |
| 4,994,205 | 2/1991 | Towers . |
| 5,085,958 | 2/1992 | Jeong . |
| 5,124,072 | 6/1992 | Dole et al. . |
| 5,124,558 | 6/1992 | Soltani et al. . |
| 5,156,770 | 10/1992 | Wetzel et al. . |
| 5,166,456 | 11/1992 | Masahiko . |
| 5,204,021 | 4/1993 | Dole . |
| 5,213,712 | 5/1993 | Dole . |
| 5,242,620 | 9/1993 | Dole et al. . |
| 5,296,117 | 3/1994 | De Jaeger et al. . |
| 5,302,423 | 4/1994 | Tran et al. . |
| 5,438,240 | 8/1995 | Cathey et al. ..... 445/24 |

FOREIGN PATENT DOCUMENTS

| | | | |
|---|---|---|---|
| 54-110780 | 8/1979 | Japan | 445/52 |
| 61-237341 | 10/1986 | Japan | 445/24 |

OTHER PUBLICATIONS

*Cathodoluminescence: Theory and Application*, Chapters 9 and 10, VCH Publishers, New York, NY, 1990.

"Cathodoluminescent Materials," *Electron Tube Design, D. Sarnoff Res. Center Yearly Reports & Review*, 1976, pp. 128–137.

(List continued on next page.)

*Primary Examiner*—P. Austin Bradley
*Assistant Examiner*—Jeffrey T. Knapp
*Attorney, Agent, or Firm*—Kelly K. Kordzik; Winstead Sechrest & Minick P.C.

[57] ABSTRACT

A system and method for producing thin, uniform powder phosphors for field emission display screens features a planarization of the phosphor powder layer. That planarization is accomplished by placing the deposited phosphor layer in an anode plate between two optical flats, which are then mounted within a mechanical press.

4 Claims, 3 Drawing Sheets

OTHER PUBLICATIONS

"Electron Microscopy of Nucleation and Growth of Indium and Tin Films" *Philosophical Magazine,* vol. 26, No. 3, 1972, pp. 649–663.

"Improved Performance of Low Voltage Phosphors for Field Emmission Displays, " *SID Display Manufacturing Conf.,* Santa Clara, CA, Feb. 2, 1995.

"Phosphor Materials for Cathode–Ray Tubes, " *Advances in Electronics and Electron Physics*, vol. 17, 1990, pp. 271–351.

"Phosphors and Screens," *Advances in Electronics and Electron Physics*, vol. 67, Academic Press, Inc., 1986, pp.254, 272–273.

"The Chemistry of Artificial Lighting Devices—Lamps, Phosphors and Cathode Ray Tubes," *Studies in Inorganic Chemistry 17,* Elsevier Science Publishers B.V., The Netherlands, 1993, pp. 573–593.

"Method for Producing Thin, Uniform Powder Phosphor for Display Screens," Ser. No. 08/304,918 filed 09/13/94, Now U.S. Pat. No. 5,531,880.

METHOD FOR PRODUCING THIN UNIFORM POWDER PHOSPHOR FOR DISPLAY SCREENS

CROSS REFERENCES

This is a division of application Ser. No. 08/304,918 filed Sep. 13, 1994, now U.S. Pat. No. 5,531,880.

U.S. Pat. Nos. 5,199,918; 5,312,514; 5,543,684; and 5,449,970, and U.S. patent application Ser. No. 07/993,863, now abandoned in favor of a continuation that is now U.S. Pat. No. 5,548,185, all assigned to a common assignee, are hereby incorporated by reference herein.

TECHNICAL BACKGROUND OF THE INVENTION

The present invention relates generally to a method for producing a phosphor layer for a display screen, and more particularly to a method for making a phosphor layer including planarizing by mechanical pressing.

BACKGROUND OF THE INVENTION

The flat panel display market is growing quite rapidly. In this market, field emission (cold emission) displays comprise one of the most promising technologies for the future. Such displays are subjects of the patents and patent applications cross-referenced herein.

A field emission flat panel display actively produces light from an area through the bombardment of a phosphor layer with electrons emitted from a low work function material as a result of the application of an electrical field. Such field emission devices depend upon a uniform layer of phosphor in order to achieve uniform brightness over large areas of a display.

The electric field, which causes the electrons to emit from a low work function (work function is the minimum energy required to liberate an electron from a solid, typically measured in electronvolts at absolute zero temperature) material towards the phosphor layer, is passed between a pair of electrodes. Often, one or more additional electrodes may be utilized to assist in controlling and directing the emission of electrons towards the phosphor layer. Please refer to U.S. Pat. No. 5,449,970 and U.S. application Ser. No. 07/993,863, cross-referenced above, for further discussions of diode, triode, tetrode, pentode, et seq. field emission devices.

Because of lower manufacturing costs and ease of manufacturing, diode structure (only two electrodes) field emission devices are desirable, but are more difficult to implement than triode, tetrode, et seq. devices since the required gap (on the order of microns) between the low work function material and the phosphor layer must be precisely maintained to achieve a uniform bombardment of electrons upon the phosphor layer, resulting in the desired uniform brightness throughout the display. An added difficulty arises from the fact that a diode structure field emission device requires a much smaller gap than triode, tetrode, pentode, et seq. devices. Thus, achieving a flat and uniformly distributed phosphor layer is increasingly important with diode structure devices, since even small variations throughout the layer will affect the gap distance.

One present technology for phosphor deposition is a screen printing technique, which typically produces a 10–25 μm thick phosphor fill. Another technique, electrophoretic deposition, typically produces a 3–6 μm thick phosphor film often resulting in a 200% variation in thickness throughout the layer. The films produced by these techniques are not uniform.

Thus, it is quite apparent that in order to improve the performance of flat panel displays, such as triode, tetrode, pentode, et seq. field emission displays, and to make more feasible a diode field emission display, a uniform gap between the emission material and the phosphor layer is critical for achieving uniform brightness over large areas. To assist in achieving this goal, it is important that a flat and uniformly distributed phosphor layer be coated so that a uniform emission of photons results upon activation by electrons within the field emission device. Thus, there is a need in the art for a method of producing a powder phosphor film in a thin, uniform layer.

SUMMARY OF THE INVENTION

Thus, it is an object of the present invention to produce a thin, uniform powder phosphor film for a display screen. In the attainment of this object, the present invention deposits a phosphor on a support and then planarizes this deposited phosphor with a mechanical press.

In a preferred embodiment, the present invention includes the steps of depositing a 3–30 μm thick powder phosphor film by an electrophoretic process on a glass substrate with an indium doped tin oxide (ITO) coating (the resulting structure often referred to hereinafter as the "sample"), stacking an optical flat on the phosphor coated side of the sample produced by the deposition of the phosphor film and the ITO on the glass substrate, and loading the sample onto a mechanical press, and applying pressure at 1,000 pounds per square inch (psi) or higher to force the optical flat and the substrate towards each other, thus planarizing the phosphor layer.

Thereafter, the sample may be cured in an oven in an inert atmosphere up to 450° celsius.

Optionally, a second planarization and cure may be performed on the sample.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWING

For a more complete understanding of the present invention, and the advantages thereof, reference is now made to the following descriptions taken in conjunction with the accompanying drawings, in which.

DETAILED DESCRIPTION OF A PREFERRED EMBODIMENT OF THE INVENTION

Figure 1:
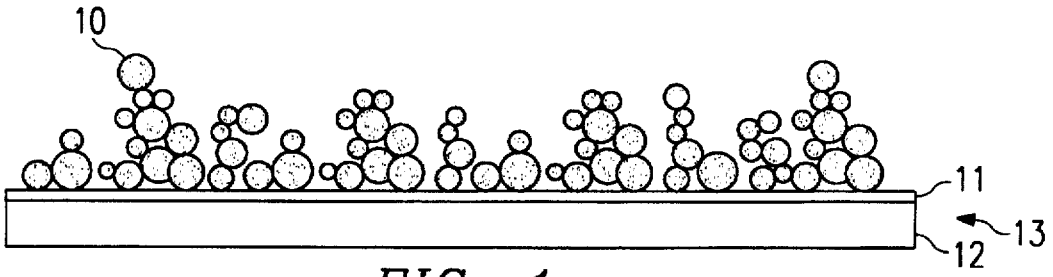
FIG. 1 illustrates a deposited powder phosphor film on a glass substrate prior to planarization by the present invention.
Figure 2:
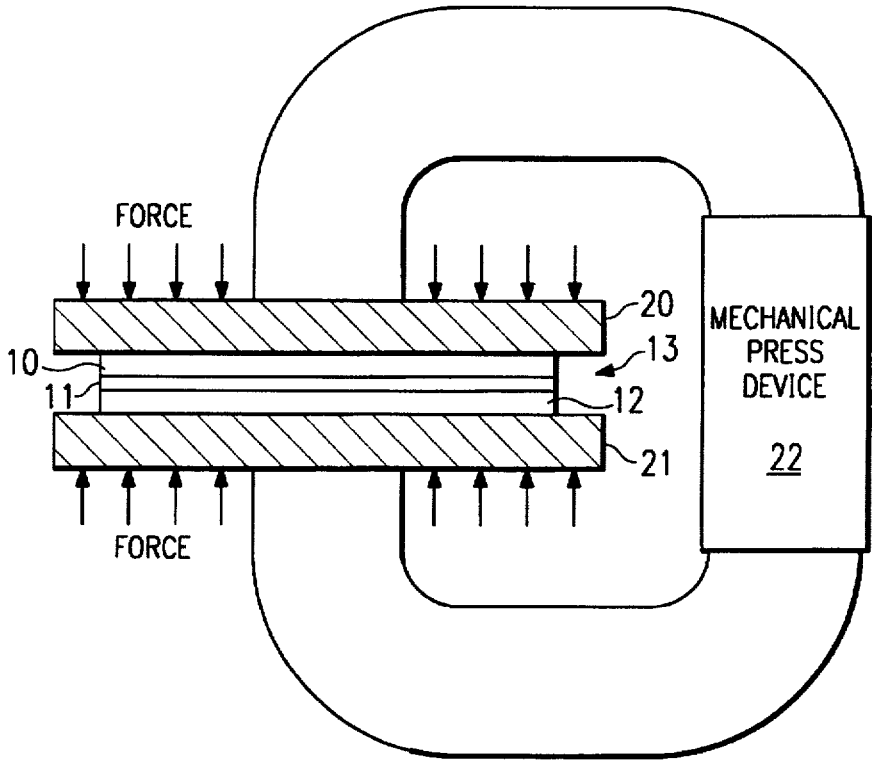
FIG. 2 illustrates planarization of the powder phosphor film by mechanical pressing.
Figure 3:
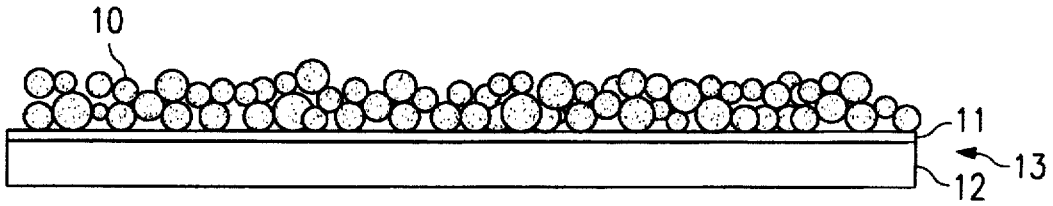
FIG. 3 illustrates the powder phosphor film layer subsequent to planarization in accordance with the present invention.

Referring now to the drawings wherein depicted elements are not necessarily shown to scale and wherein like or similar elements are designated by the same reference numeral through the several views, and more particularly to FIGS. 1–3, there are shown successive views of the application of powder phosphor to a glass substrate according to a particularly preferred embodiment of the present invention.

With reference now to FIG. 1, a large area substrate 12 is provided. Substrate 12 is preferably glass and/or quartz, although other suitable materials may be used, the requirement being they provide a base upon which a thin film of ITO coating 11 (if desired) and phosphor powder 10 can be deposited.

Sample 13 (comprising substrate 12, ITO 11 and phosphor 10) may then be used within a field emission device as discussed within the cross-referenced patent and patent applications. For example, sample 13 may be utilized as an anode plate for a diode structure field emission flat panel display. Note, if the field emission device utilizing sample 13 is of a triode, tetrode, pentode, or some other multielectrode device with more than two electrodes, then ITO layer 11 may not be necessary and phosphor 10 may be directly applied to substrate 12, since addressing of sample 13 may not be necessary with such devices.

Figure 4:
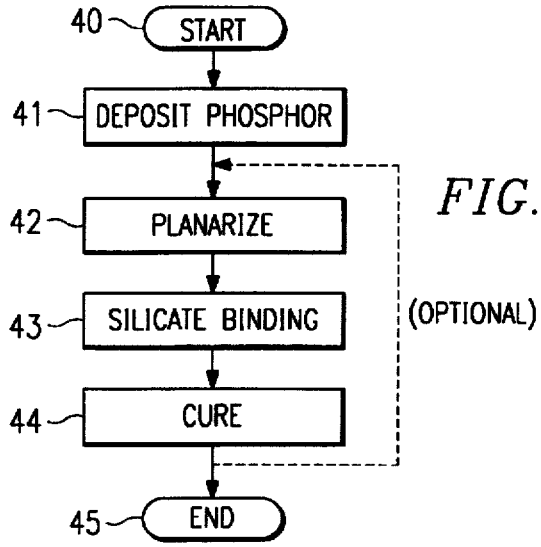
FIG. 4 illustrates a flow diagram of the process of a preferred embodiment of the present invention.

Referring to FIG. 4, there is illustrated a flow diagram of a process of a preferred embodiment of the present invention. The process begins at step 40, and proceeds to step 41 wherein approximately a 3–30 μm thick powder phosphor film 10 is deposited by a well-known electrophoretic process onto ITO 11 and substrate 12. Electrophoresis is the movement of colloidal particles in a liquid under the influence of an electric field. Note, other well-known techniques for depositing phosphor may be utilized.

As an example, a typical phosphor solution utilized for display screens is prepared. Whether prepared or acquired as a stock solution, it is desired that phosphor particles be of 1–2 μm in size. Such a typical phosphor solution may be prepared by combining in a clean storage container: (1) 1 gram phosphor (sieved through approximately a 250 mesh screen); (2) 100 milliliters isopropanol ("IPA"; cleanroom grade); (3) 0.0025 grams $Al(NO_3)_3.9H_2O$; (4) 0.0025 grams of $La(NO_3)_3.6H_2O$; and (5) 2 milliliters $H_2O$. Items (3)–(5) may be combined into a stock solution, which will save a significant mount of weighing time. This stock electrolyte solution can be stored indefinitely.

The solution is mixed thoroughly and ultrasonically treated at a fairly intense level (>50 watts) for two minutes in order to break up particle agglomerates. Ultrasonic treatment is done by directly immersing a clean ultrasound horn into the solution. For greater breaking of agglomerates, the solution may be subjected to intense ultrasound (75 watts) for five additional minutes. Additional ultrasonic treatment may be used if desired. As long as the phosphor does not dry out, additional ultrasound should not be necessary.

The conductivity of the deposition solution is an important measure of the quality of the solution, and, as such, it should be monitored at regular intervals.

Before measuring the conductivity of the solution, the conductivity meter utilized should be standardized. First, the meter should be allowed to warm up several minutes before taking a reading. Also, it should be ensured that the temperature of the standard solution and the deposition solution are the same. The conductivity standard solution is prepared with 0.05 grams of KCl (potassium chloride) in one liter of DI (dionized) water. The solution is then mixed well. The conductivity of the standard solution should be around 100 μS/cm (S=Seimen or $ohm^{-1}$). Specifically, one gram per liter of KCl in water (1,000 parts per million) will give a specific conductivity of 1880 μS/cm at 25° C. The conductivity scales fairly linearly with concentrations below 2000 μS/cm. The KCl solution is used as the calibrated standard and the supplied standards are only used to prepare more KCl solution. Then the conductivity meter probe is emersed in the solution until the electrodes are fully in the solution. Care must be taken to remove air bubbles out of the probe. The reading on the conductivity meter should be allowed to stabilize for several seconds. And, then the calibration knob on the conductivity meter should be manipulated in order to calibrate the meter so as to standardize the conductivity meter.

Thereafter, the conductivity of the solution is measured. Small amounts of water may be added to the solution to increase the conductivity, which is preferably between 5 and 9 μS/cm; more IPA may be added to decrease the conductivity. It is important that all sources of water are kept separate from the prepared solution. Generally, the solution life time may be up to one month, as long as the conductivity remains relatively between 5 and 9 μS/cm and the depositions appear good. At the end of the solution life time, the phosphor should be allowed to settle out of the solution, the IPA is decanted off and the phosphor is dried out by either air drying or gentle heating. The phosphor is then washed several times with DI $H_2O$ to remove electrolytes and then it is dried again. The phosphor may then be reused.

Substrate 12, after applying ITO 11 in a well-known manner (if desired), is then washed and a mask (e.g., aluminum) placed thereon. Washing may be performed by ultrasonically treating the sample in a 5% micro solution, rinsing thoroughly in $H_2O$ and other various solutions such as DI $H_2O$, acetone and methanol, and then blow drying with nitrogen. The sample may then be stored in a clean place, such as on wafer carriers.

When placing the mask onto the sample, the display area should be fully exposed. The mask should be pressed as flat as possible against the sample and as close to the display area as possible.

Thereafter, the deposition apparatus utilized should be prepared by first standardizing the conductivity meter, as discussed above. Then, the deposition bath container should be cleaned and a Teflon stir bar should be placed therein. The deposition solution is then again mixed and poured into the deposition container. The solution conductivity is then checked so that it is preferably between 5 and 9 μS/cm. Thereafter, the conductivity probe is rinsed off with clean IPA and air dried and the deposition temperature is noted. The whole container is then placed on a magnetic stirrer for gentle stirring. Next, the electrodes are prepared by cleaning a stainless steel (or other inert metal, e.g., Ni, Pt, etc.) counter-electrode and mounting it and then cleaning the cathode (sample) connector. Stirring is stopped, which allows larger agglomerates to settle out of the solution before deposition begins. Stirring should be ceased at least 30 seconds before a deposition is commenced.

The mask and sample 13 are then mounted into a typical apparatus utilized for electrophoresis to deposit phosphor 10. A connector should be placed in contact with the electrical contacts on the display side of sample 13. The display side of sample 13 should be mounted facing the counter-electrode. Sample 13 is then lowered into the deposition bath along with the counter-electrode. Sample 13 should be lowered to the point of fully covering the display area. Electrodes need to be parallel and 25±5 millimeters apart.

A potential is then applied between the electrodes to provide a current density in the preferred range of 0.1–10 $mA/cm^2$.

Phosphor 10 is then deposited and may be varied due to the desired thickness and density of the phosphor deposit. For a typical deposition using V=200V and a current density of 1 $mA/cm^2$, a 5 second deposition will result in approximately 50% theoretical density and a 3 micrometer thick deposit. A 30 second deposition under the same conditions will result in 99% theoretical density and an 8–9 micrometer deposit after all subsequent procedures have been performed. Alter the desired deposition of phosphor 10 is achieved on substrate 12 and ITO 11, sample 13 is removed.

The mask is then removed and sample 13 is washed with IPA and allowed to air dry. The washing with IPA should be done by gently spraying sample 13 near the top on the copper pads and allowing the IPA to wash down over the deposition. If a loose phosphor "wash line" should appear on the deposit, it may be removed by directing a very gentle stream of IPA at the line. If the stream is too hard, it may remove phosphor 10 on the ITO 11. Air drying should be done in a vertical position to avoid unwanted particulates, and should be done in a clean room, if possible. Additionally, excess phosphor 10 may be removed with a lint-free wipe. Only the display area should have phosphor 10 on it. Thus, the back side of sample 13 should be cleaned. The clean sample 13 is then air baked at 110° C. for 1 hour to remove additional water.

Referring next to FIGS. 2 and 4, sample 13 with the deposited phosphor 10 is then mounted between two optical flats 20, 21. Optionally, some other type of member may take the place of optical flat 21 in order to supply a force to the underside of substrate 12. Optical flats 20, 21 may be prepared by cleaning with methanol and then air dried and/or blown with dry nitrogen.

The pressing parts should be stacked in the following arrangement (from bottom to top): bottom metal standoff, lint-free wipe, optical flat 21, sample 13 (face-up), optical flat 20 (directly aligned over optical flat 21), lint-free wipe, top metal standoff, ballbearing.

Figure 7:
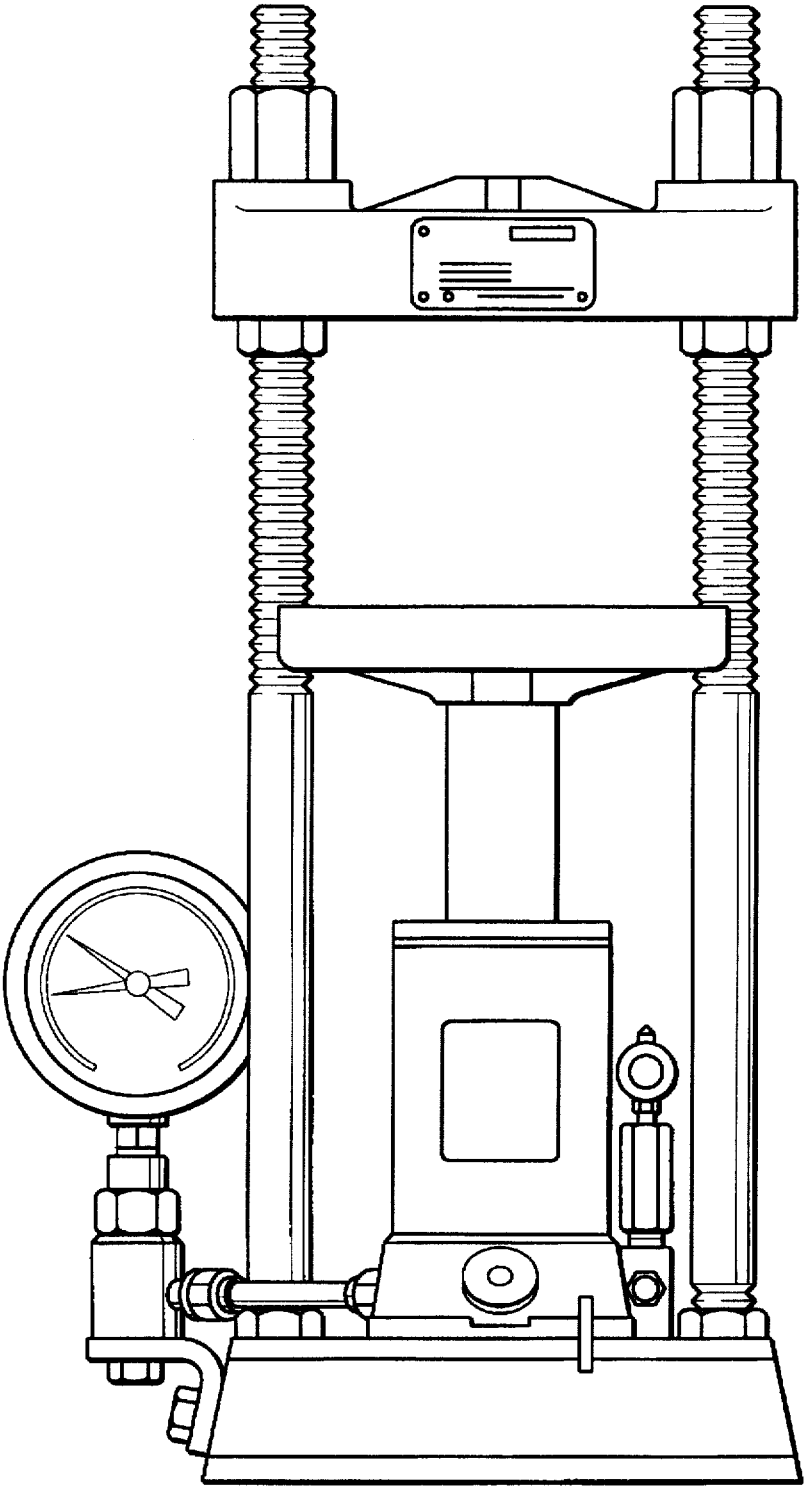
FIG. 7 (PRIOR ART)
FIG. 7 illustrates a mechanical press used in accordance with a preferred embodiment of the present invention.

The stacked portions shown in FIG. 2 are then loaded into mechanical press 22, and a high pressure force is then applied by press 22 to compress optical flats 20, 21 towards each other (step 42). Press 22 may be a Carver Model-C 12 Ton Laboratory Press (shown in FIG. 7). However, any uniaxial press that can supply the required force may be used. These presses are available from most lab supply retailers (Cole-Parmer, Baxter, SpectraTech, Harrick, etc.). Optical flats 20, 21 may each be a disk (usually quartz or Zerodur but can be of other materials) that has been polished so that its surface roughness is less than approximately 150 nm. Such optical flats are available from numerous commercial optics suppliers including Edmund Scientific, Oriel, etc. Essentially, press 22 is simply a modified hydraulic jack.

In a preferred embodiment, the applied force may be between 500 and 5,000 psi (pounds per square inch), though other force magnitudes may be used as desired. Thereafter, sample 13 and optical flats 20, 21 are removed from mechanical press 22. Optical flat 20 is preferably removed vertically from phosphor 10. This is preferably done by holding the back of flat 20 as a lever point and lifting the front up and away. A horizontal motion should be avoided in removing optical flat 20 since it may wipe off some of phosphor 10. If there is phosphor "lift-off" onto optical flat 20, sample 13 may be recleaned and redeposited with phosphor 10 and the planarization (step 42) repeated.

Next, optical flats 20, 21 may be cleaned for the optional next planarization described below.

Thereafter, sample 13 may again be washed with IPA, as described above, and dried. Sample 13 is then dipped (step 43) into a silicate solution (e.g. a 0.525% potassium silicate solution). The application of silicate solution performs a silicate binding operation on phosphor 10 so that phosphor 10 adheres more to the substrate. A typical binder solution is prepared with 15 milliliters of Kasil 2135 (a 35% electronic grade potassium silicate solution) and 985 milliliters of $H_2O$. The solution lifetime may be indefinite. However, if an excess of phosphor particulates or other foreign material are noticed or the solution has evaporated to any appreciable extent, it should be replaced with a fresh solution before utilizing. The silicate solution is then poured into a clean 250 milliliter beaker, and sample 13 is then dipped into the silicate solution in a slow, smooth motion. Sample 13 is then removed and any excess silicate is removed by wiping with a lint-free cloth on both sides. Excess silicate solution may be removed by gently tapping sample 13 to cause the excess silicate solution to move off the deposited phosphor 10 where it can be absorbed by a wipe. Sample 13 should be kept in a horizontal position as much as possible. Sample 13 is then allowed to air dry. If desired, removed phosphor may be recovered. A surfactant such as methanol, ethanol, IPA, or any of a number of commercially available surfactants can be added to the silicate solution to enhance the wetting and penetrating abilities of the silicate. Depending on the surfactant used, 0.001% to 5% by volume of the surfactant can be added to the silicate solution. In a preferred embodiment, 3% methanol is added to the silicate solution.

Next, sample 13 is placed into a curing (baking) container which is then placed into an oven with an inert atmosphere flowing at ca. 5 standard liters per minute (slm), preferably comprised of $N_2$ (nitrogen). A ramped bake is then initiated within the baking container up to 450° C. (step 44). In a preferred embodiment, this ramped bake may follow the following standard temperature program: (1) dwell at 250° C. for 5 minutes, (2) ramp to 300° C. at 5° C./minute, (3) dwell at 300° C. for 5 minutes, (4) ramp to 350° C. at 5° C./minute, (5) dwell at 350° C. for 5 minutes, (6) ramp to 400° C. at 5° C./minute, (7) dwell at 400° C. for 5 minutes, (8) ramp to 450° C. at 2° C./minute, (9) dwell at 450° C. for 5 minutes, and (10) return to 250° C.

Then, sample 13 is removed from the oven and allowed to cool.

After this first planarization, the thickness variation, or uniformity, of the deposited phosphor powder 10 is dropped to 5% or less of the total maximum thickness of phosphor 10 with the overall thickness being reduced to approximately 5 μm. The planarized sample 13 is illustrated in FIG. 3, which may be compared to FIG. 1.

Optionally, a second planarization and cure process may be implemented, wherein optical flats 20, 21 are again applied to sample 13 and then mounted within mechanical press 22 (return to step 42). Optical flat 20 may be rotated 180 degrees to compensate for any unevenness in flat 20 during the second planarization. Step 43 of dipping sample 13 into a silicate solution may also be repeated along with the ramped bake process (step 44) described above. The process ends at step 45.

This second planarization process further lowers the thickness variation to approximately 2–3% of the maximum thickness of phosphor 10 within the deposited phosphor layer 10.

Thereafter, a test of the adherence of phosphor layer 10 upon sample 13 may be performed. Beginning at 40 psi, a focused stream of dry $N_2$ is directed at sample 13. In a sweeping motion, the stream of dry $N_2$ is increased to a flow of 80 psi. The phosphor layer 10 should remain adherent under this pressure.

Other tests may be performed upon sample 13. For example, a test for surface uniformity and thickness may be performed with a profilometer. A test of emission may be performed with an electron gun or similar device. A test for uniformity of phosphor 10 may be performed with an ultraviolet lamp. And a test of adherence may also be performed with a ball tester.

The above baking times are given generally for a single sample of phosphor 10 upon sample 13. Obviously, many samples may be dried and baked at the same time, with adjustments in the baking process.

Further, if it is desired to keep the vapor pressure of the deposition solution down, the following two changes may be made: (1) use 75% IPA and 25% methyl carbitol as the deposition solution solvents and (2) lower the deposition temperature to ca. 5° C.

The technique of the present invention may be applied to a curved substrate and phosphor combination by use of an appropriately shaped planarization device.

Moreover, a pattern stamp could be formed within optical flat 20 to form some type of pattern in phosphor 10.

Figure 5:
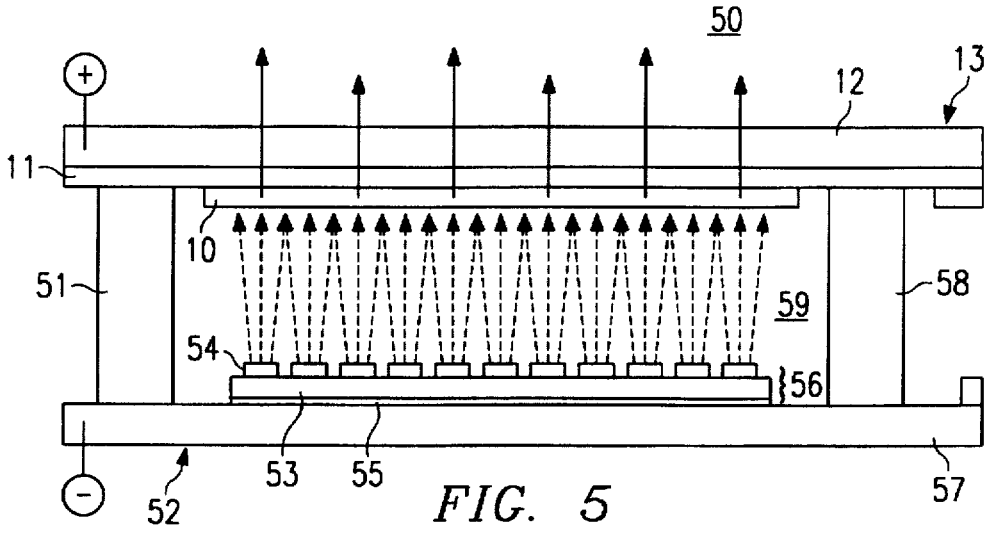
FIG. 5 illustrates a portion of a flat panel display device implementing a phosphor deposited in a manner set forth herein.

Referring now to FIG. 5, there is illustrated a portion of a flat panel display device 50, which makes use of an anode plate (i.e., sample 13) manufactured by the present invention. Cathode assembly 52 comprises substrate 57, typically glass, conductive layer 55, resistive layer 53, and low work function emitting material 54. Conductive layer 55, resistive layer 53 and material 54 comprise cathode strip 56, which may be addressable by driver circuitry (not shown).

Sample 13 comprises, as described above, substrate 12, conductive layer 11, and phosphor 10, deposited in the manner described above.

Device 50 illustrates a diode structure field emission device providing the capability of being matrix addressable through conductive layers 11 and 55. As a result, the portion of device 50 shown may be a pixel location within a flat panel display, which is addressable by driver circuitry driving the display.

As discussed above, the present invention is utilized so that space 59 between material 54 and phosphor 10 is uniform. Spacers 51 and 58 assist in the mounting of assemblies 13 and 52 together.

For further discussion of the device illustrated in FIG. 5, refer to Ser. No. 07/995,847, cross-referenced herein.

Figure 6:
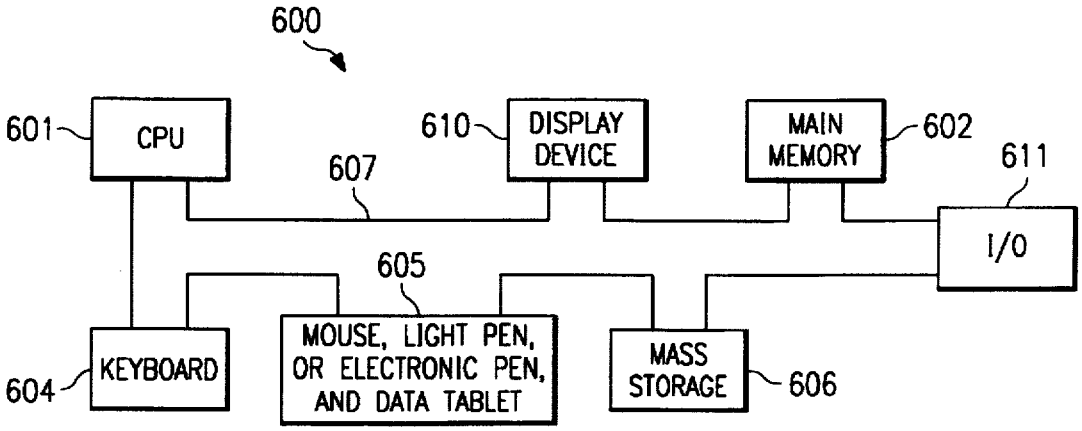
FIG. 6 illustrates a data processing system with a display device made in a manner set forth herein.

Referring next to FIG. 6, there is illustrated data processing system 600 employing display device 610 produced in accordance with the present invention. Display device 610 is coupled to microprocessor ("CPU") 601, keyboard 604, input devices 605, mass storage 606, input/output ports 611, and main memory 602 through bus 607. All of the aforementioned portions of system 600 may consist of well-known and commercially available devices performing their respective functions within a typical data processing system. Display device 610 may be a cathode ray tube, a liquid crystal display, a field emission display such as illustrated in FIG. 5, or any other type of display that utilizes a phosphor layer for emission of photons to produce images on a display.

Sample 13 may also be utilized within device 50, which may be utilized as a backlight source for a liquid crystal display for display device 610.

Although the present invention and its advantages have been described in detail, it should be understood that various changes, substitutions and alterations can be made herein without departing from the spirit and scope of the invention as defined by the appended claims.

What is claimed is:

1. A method of making a display device, said method comprising the steps of:

providing an electron emitting device;

depositing a phosphor on a substrate;

planarizing said deposited phosphor with a mechanical press; and mounting said substrate a specified distance from said electron emitting device.

2. The method as recited in claim 1 wherein said display device is a flat panel display.

3. The method as recited in claim 1 wherein said display device is a field emission display device.

4. The method as recited in claim 1 wherein said planarizing step further comprises the steps of:

placing an optical flat on said deposited phosphor; and pressing said optical flat towards said substrate with said mechanical press.

* * * * *